United States Patent [19]

Miyake et al.

[11] Patent Number: 4,494,702

[45] Date of Patent: Jan. 22, 1985

[54] YARN WINDING APPARATUS

[75] Inventors: Yuzuru Miyake; Takami Sugioka; Shoichi Murakami; Hideaki Ibuki, all of Matsuyama, Japan

[73] Assignee: Teijin Seiki Co., Ltd., Osaka, Japan

[21] Appl. No.: 437,523

[22] Filed: Oct. 29, 1982

[30] Foreign Application Priority Data

Nov. 4, 1981 [JP] Japan ..... 56-163756[U]

[51] Int. Cl.[3] ..... B65H 54/02; B65H 54/38; B65H 59/38

[52] U.S. Cl. ..... 242/18 R; 242/18.1; 242/36; 242/45

[58] Field of Search ..... 242/18 R, 45, 18.1, 242/36, 39

[56] References Cited

U.S. PATENT DOCUMENTS

| | | | |
|---|---|---|---|
| 3,536,272 | 10/1970 | Ueyama | 242/45 |
| 3,860,187 | 1/1975 | Liska et al. | 242/45 |
| 4,049,211 | 9/1977 | Spescha | 242/45 |
| 4,059,239 | 11/1977 | Hori et al. | 242/18 R X |
| 4,069,985 | 1/1978 | Lohest et al. | 242/45 |
| 4,245,794 | 1/1981 | Hasegawa et al. | 242/45 |
| 4,307,848 | 12/1981 | Barathieu | 242/18 R |
| 4,394,986 | 7/1983 | Hasegawa et al. | 242/18 R |

*Primary Examiner*—Stanley N. Gilreath
*Attorney, Agent, or Firm*—Burgess, Ryan & Wayne

[57] ABSTRACT

A spindle drive type winding apparatus wherein a spindle onto which a bobbin for winding a yarn thereonto to form a yarn package is inserted is driven so that a predetermined winding factor is controlled in accordance with a predetermined program. The spindle drive type winding apparatus is provided with a control device which comprises:

a peripheral speed detector for detecting the peripheral speed of the yarn package and generating a peripheral speed signal;

a control for controlling the rotational speed of the spindle and generating a control signal;

a circuit for calculating the wound amount of the yarn package based on the peripheral speed signal emitted from the peripheral speed detector and the signal emitted from the control and for generating a radius signal; and a function generator for emitting a programmed winding signal obtained in accordance with a pattern based on theradius signal emitted from the calculating circuit.

The winding factor may be a peripheral speed of the yarn package, and in this case the peripheral speed is detected by means of the peripheral speed detector.

The winding factor may be tension in wound yarn, and in this case the tension in yarn is detected by means of a tension detector.

The winding apparatus may be driven at a constant wind ratio or at a constant wind angle.

5 Claims, 4 Drawing Figures

YARN WINDING APPARATUS

TECHNICAL FIELD TO WHICH THE INVENTION RELATES

This invention relates to a spindle drive type yarn winding apparatus, especially a control device of a yarn winding apparatus wherein a spindle is driven. The present invention is intended to provide a control device by which a yarn package having a good wound configuration and facilitating easy unwinding of yarn can be obtained.

RELEVANT BACKGROUND ART

Conventionally, in order to control a yarn winding speed of the spindle drive type yarn winding apparatus wherein a yarn is wound onto a bobbin while the rotational speed of a spindle is controlled, the following methods have been utilized.

1. A method wherein tension in a winding yarn is controlled at a predetermined constant value by utilizing a tension meter for detecting the tension.

2. A method wherein peripheral speed of a yarn package formed by winding a yarn about a bobbin is controlled at a predetermined value by utilizing a contact roller or the like which is in contact with the peripheral surface of the wound package.

In order to increase production efficiency, the amount of a yarn in a package has been increased, and accordingly, the diameter of a wound package has also increased. When a large package is wound at a constant tension by means of the tension control method described in item 1 above, a defect called "bulge," wherein yarn located at the inner layer of a package bulges from the side of the package due to a strong winding force, occurs, and therefore, it is very difficult to adjust winding conditions including a set value of tension in the yarn at adequate conditions.

When a yarn is wound at a constant peripheral speed by means of the method 2 described above, the rotational speed of a spindle at almost completion of a full package is considerably lower than that at the beginning of winding, for example, by one third to one fourth. If a yarn is wound at a constant wind or at a constant wind ratio the traverse speed is decreased as the rotational speed of a spindle decreases. Accordingly, the winding yarn speed which can be obtained as a vector sum of the peripheral speed and the traverse speed decreases considerably. In a winding process, such as winding of a spun yarn wherein the yarn supply speed is unchanged, the decrease of the winding speed results in a decrease of tension in the yarn and deformation of a wound package due to the excessive decrease in yarn tension. In general, it is preferable to tightly wind the inner layer of a package and to loosely wind the outer layer of the package in order to prevent occurrence of bulge in a large package. However, taking other factors, such as ease of unwinding of a yarn from a package, into consideration, a suitable tension pattern by which a package can be preferably wound is different from the above-described pattern wherein the tension in the yarn is always maintained constant.

SUMMARY OF THE INVENTION

An object of the present invention is to provide a control device for a spindle drive type winding apparatus by which a large yarn package having a good wound configuration and ease of unwinding of yarn therefrom can easily be obtained.

The present invention provides a spindle drive type winding apparatus wherein a spindle, onto which a bobbin for winding a yarn thereonto to form a yarn package is inserted, is driven so that a predetermined winding factor is controlled in accordance with a predetermined program characterized in that the spindle drive type winding apparatus is provided with a control device which comprises:

a peripheral speed detector for detecting the peripheral speed of the yarn package and generating a peripheral speed signal;

a control for controlling the rotational speed of the spindle and generating a control signal;

a circuit for calculating the wound amount of the yarn package based on the peripheral speed signal emitted from the peripheral speed detector and the signal emitted from the control and for generating a radius signal; and a function generator for emitting a programmed winding signal obtained in accordance with a pattern based on the radius signal emitted from the calculating circuit.

The term "wound amount" used in the present specification and the claims attached thereto means radius or diameter of a yarn package, or thickness of the wound layer of a yarn package.

The winding factor of the present invention may be the peripheral speed of the yarn package, and in this case the peripheral speed is detected by means of the peripheral speed detector.

The present invention is also applicable to a spindle drive type winding apparatus wherein the winding factor is the tension in the yarn to be wound, and in this case the tension in the yarn is detected by means of a tension detector.

The winding apparatus of the present invention may be driven at a constant wind ratio or at a constant angle of wind.

BRIEF DESCRIPTION OF THE ACCOMPANYING DRAWINGS

The present invention will now be explained in detail with reference to accompanying drawings illustrating some embodiments of the present invention, wherein.

Figure 3:
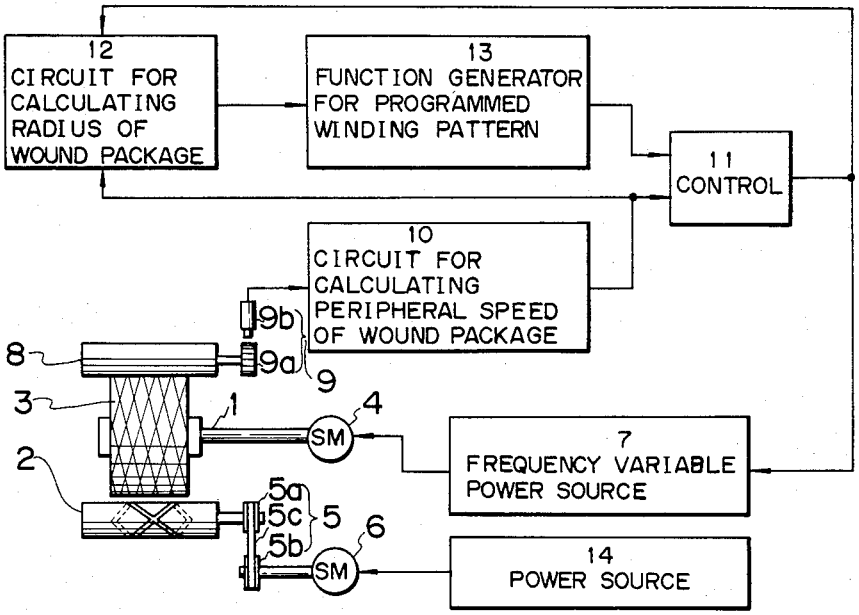
Figure 4:
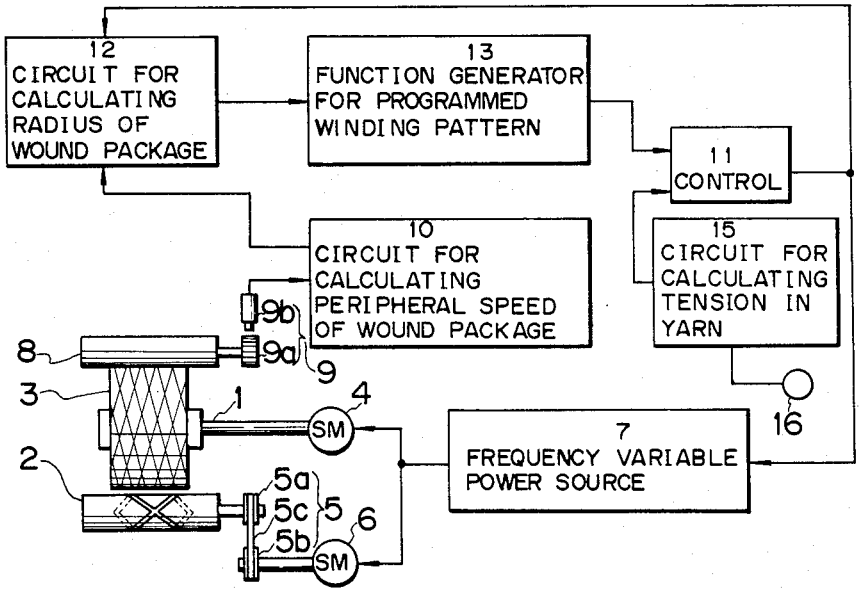

FIG. 3 is a block diagram of the second embodiment applied to a spindle drive type winding apparatus wherein a spindle is driven at a constant angle of wind in such a manner that the peripheral speed of the yarn package is also controlled in accordance with a predetermined program; and FIG. 4 is a block diagram of the third embodiment applied to a spindle drive type winding apparatus wherein a spindle is driven at a constant wind ratio in such a manner that the tension in the winding yarn is controlled in accordance with a predetermined program.

DETAILED DESCRIPTION OF THE INVENTION

Figure 1:
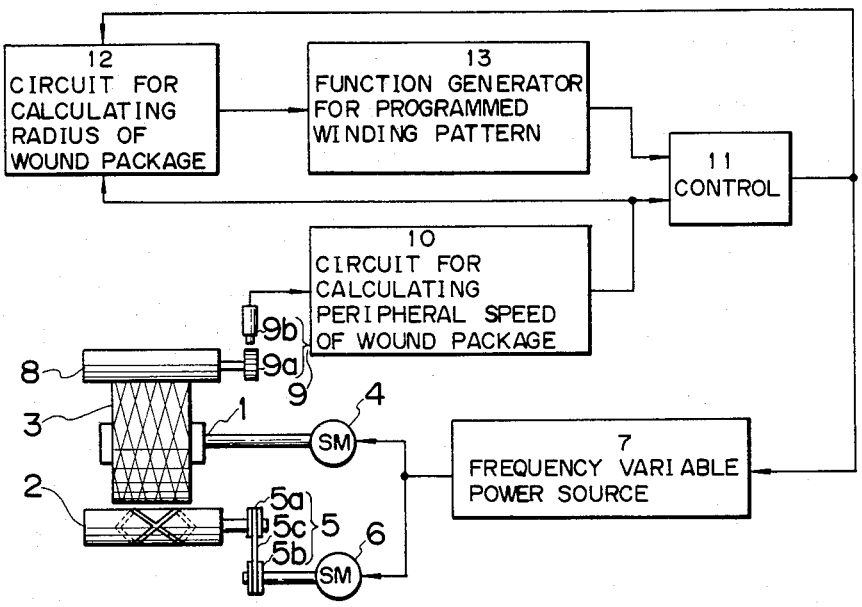
FIG. 1 is a block diagram of the first embodiment applied to a spindle drive type winding apparatus wherein a spindle is driven at a constant wind ratio in such a manner that the peripheral speed of the yarn package is controlled in accordance with a predetermined program.

Referring to FIG. 1, a spindle 1 is connected to a synchronous motor 4. A traverse cam 2 which is a part of a traverse device (not numbered) is connected to another synchronous motor 6 by means of a wind ratio adjusting mechanism 5 and effects a traverse motion to a traverse guide (not shown). The wind ratio adjusting mechanism 5 comprises a timing pulley 5*a* connected to the traverse cam 2, a timing pulley 5*b* connected to the synchronous motor 6 and a timing belt 5*c* wrapping around the pulleys 5*a* and 5*b*. The wind ratio can be adjusted at a predetermined value by changing the combination of the pulleys 5*a* and 5*b*. A yarn (not shown) fed at a predetermined speed is traversed by means of the traverse device and is wound onto a bobbin (not numbered) which is inserted onto the spindle 1 to form a yarn package 3. The synchronous motors 4 and 6 are connected to a common frequency variable power source 7. As a result, the spindle 1 and the traverse cam 2 constituting the traverse device are driven at a constant speed ratio which is set by means of the wind ratio adjusting mechanism, and accordingly, a yarn is wound onto a bobbin at a constant wind ratio.

As described above, the drive system of this embodiment is so constructed that the winding apparatus of this embodiment can wind a yarn at a constant wind ratio. This construction of the above-described drive system has advantages: that it can perform winding at a constant wind ratio without introducing any proportional control system for systems driving the traverse device and the spindle; and that it can readily be applied to an automatic bobbin changing type winding apparatus wherein spindles are alternately changed since the spindle 1 and the traverse device 2 are not connected to each other by means of a mechanical connecting means and are mechanically independent.

The above-described drive system is controlled as follows by means of a winding control means. The peripheral speed of the package 3 is detected by means of a touch roller 8 or contact roller rotatable in friction contact with the outer surface of the yarn package 3 and a peripheral speed detecting means 9. The peripheral speed detecting means 9 comprises a gear 9*a* connected to the touch roller 8 to detect the rotational speed of the touch roller 8 and an electromagnetic pickup 9*b*. A signal detected by the pickup 9*b* is converted into a peripheral speed signal by means of a circuit 10 for calculating the peripheral speed of the wound package, and the peripheral speed signal is introduced into both a control 11 and a circuit 12 for calculating the radius of the wound package which will be explained later. The peripheral speed signal is compared with a programmed signal emitted from a function generator 13 at the control 11. The function generator 13 is programmable and emits signals in accordance with a programmed winding pattern. The control 11 supplies a control signal to an input of a frequency variable power source 7 so that the peripheral speed signal coincides with the programmed signal. The frequency variable power source 7 supplies to synchronous motors 4 and 6 electric power of a frequency corresponding to the control signal applied to the input. The synchronous motors 4 and 6 rotate at rotating speeds corresponding to the frequency of the input power source. Accordingly, the peripheral speed of the yarn package 3 is controlled in such a manner that it follows the programmed signal emitted from the function generator 13.

The circuit 12 for calculating the radius of the wound package receives the peripheral speed signal emitted from the circuit 10 for calculating the peripheral speed of the wound package and the control signal emitted from the control 11. As described above, the spindle 1 is rotated in accordance with the control signal emitted from the control 11, and therefore, the control signal from the control 11 corresponds to the rotational speed of the spindle 1. Accordingly, the radius R of the wound package is calculated in the circuit 12 for calculating the radius of the wound package based on the formula $$R=\alpha V/\omega$$

wherein:

$\alpha$ stands for a coefficient;

V stands for peripheral speed signal: and $\omega$ stands for control signal.

Figure 2:
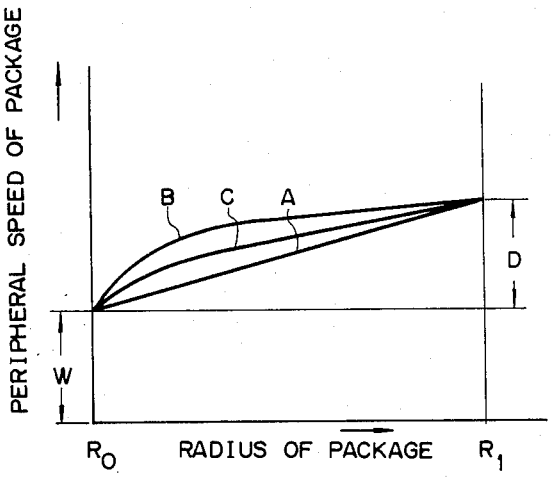
FIG. 2 is a diagram illustrating the relationship between radii of package and peripheral speeds of the package.

The function generator 13 generates a programmed signal based on the radius R of the wound package 3 as illustrated in FIG. 2 wherein radius of the wound package is plotted on the abscissa and the peripheral speed of the wound package is plotted on the ordinate.

Accordingly, when a desired winding pattern is set in the function generator 13 as a function of the radius of the wound package, the peripheral speed of the wound package 3 is controlled in accordance with the set pattern, and thus a yarn package having a desired configuration can be obtained.

The optimum peripheral speed pattern for obtaining a preferable wound configuration depends on the type of the wound yarn, such as thickness of yarn, strength of yarn, breaking elongation of yarn, and frictional force exerted on the yarn. In addition, the pattern also varies in accordance with the winding speed, winding time duration, package diameter, and traverse width. Accordingly, generally speaking the optimum pattern must be obtained through trial and error, however, basic patterns are classified in some groups. For example, pattern A illustrated in FIG. 2 by which the peripheral speed is increased at a constant rate from the beginning of the winding operation to the completion of the winding operation is preferable for obtaining a yarn package with a good wound shape when the diameter of the wound package is relatively small. In pattern B illustrated in FIG. 2, the increasing rate of the diameter of a package at the beginning of the winding operation is larger than that at the end of the winding operation. When pattern B is used, a yarn package is obtained wherein relatively uniform tension is exerted on the wound yarn, and therefore, this pattern is preferable for winding a yarn package having a relatively large difference in diameters between the beginning and the completion of the winding operation. The quality of a yarn package is determined by whether or not yarn breakage occurs during the unwinding operation of the yarn from the package rather than whether or not wound shape of the package is good. Therefore, taking into consideration such fact, peripheral speed patterns preferable for yarns of different types should be determined based on several performance tests including behavior during the unwinding operation.

It is recommended to determine the basic forms of the peripheral speed pattern and to change the basic forms by applying particular dimensions in accordance with the type of wound yarn and winding conditions.

In order to satisfy such requirements, the function generator 13 has some basic patterns therein, which are readily available. In addition, the function generator of this embodiment is so designed that an adequate peripheral speed pattern can readily be utilized by designating the peripheral speed W at the beginning of the winding operation, the increase D of the radius of the wound package $\Delta R(=R_1-R_0)$, and the increase of the peripheral speed at the completion of winding. The type of yarn being wound should be taken into consideration when designating the above factors.

Furthermore, it should be noted that the pattern of the present invention is more precise than that utilized within a generator which generates a pattern as a function of time, since the generator 13 generates a programmed signal in accordance with radius of the wound package.

In addition, the circuit 12 for calculating the radius of the wound package of the present invention utilizes the control signal emitted from the control 11 as the rotational signal of the spindle 1 in place of the actually detected rotational speed of the spindle 1. Accordingly, wiring between the spindle 1 and the speed detecting means 9 is unnecessary, and therefore, the cost for construction of the winding apparatus can be reduced. In some cases, it is possible to use the output of the frequency variable power source 7 in place of the control signal from the control 11.

The present invention has been explained with reference to FIG. 1 illustrating a block diagram of the first embodiment applied to a spindle drive type winding apparatus wherein a spindle is driven at a constant wind ratio in such a manner that the peripheral speed of the yarn package is controlled in accordance with a predetermined program. Many modifications are possible to the above-described embodiment.

Some modifications will now be explained with reference to FIGS. 3 and 4.

FIG. 3 is a block diagram of the second embodiment. The second embodiment is very similar to the first embodiment except that the synchronous motor 6 is connected to a power source 14 which is independent from the frequency variable power source 7 connected to the synchronous motor 4 for driving the spindle 1. The power source 14 generates electric power of constant frequency and drives the synchronous motor 6 at a constant speed from the beginning of the winding of a yarn package to the completion of the winding regardless of the change of frequency in the frequency variable power source 7. The synchronous motor 6 is connected to the traverse cam 2 constituting the traverse device and performs a traverse motion of the traverse guide at a constant speed. As a result, the second embodiment constitutes a spindle drive type winding apparatus wherein a spindle is driven at a constant angle of wind in such a manner that the peripheral speed of the yarn package is also controlled in accordance with a predetermined program.

In the foregoing embodiments illustrated in FIGS. 1 and 3, the peripheral speed is detected by a touch roller 8 and a peripheral speed detecting means 9 comprising the gear 9*a* and the electromagnetic pickup 9*b*. Other means for detecting peripheral speed can be employed as long as they can detect the peripheral speed of the wound package.

Similarly a detector is also applicable to the present invention for detecting the thickness of wound yarn layer in package in place of radius of package as means for detecting amount of a wound package.

The present invention is also applicable to a spindle drive type winding apparatus wherein a spindle is controlled in accordance with a predetermined tension pattern. In the above-described embodiments illustrated in FIGS. 1 and 3, the peripheral speed control system is employed, and the peripheral speed detecting means 9 is utilized to detect the radius of the wound package and control the rotational speed of the spindle 1. FIG. 4 is a block diagram of the third embodiment of the present invention applied to such a spindle drive type winding apparatus. In FIG. 4, a detector 16 of a conventional type for detecting tension in running yarn and a circuit 15 for calculating the tension in running yarn are provided; and a yarn tension detector signal emitted from the detector 16 and converted by the circuit 15 to a signal indicative of yarn tension, is input into the control 11 (instead of the peripheral speed signal in the embodiments illustrated in FIGS. 1 and 3), for comparison with the output of generator 13.

According to the present invention, the spindle drive type winding apparatus has a simple construction. Regardless of the simple construction, according to the present invention, the tension in running yarn or the peripheral speed of the wound package can be controlled at will in accordance with a programmed pattern as the package is wound, and therefore, a package having a good wound shape can easily be formed with a high winding efficiency. As described above, the present invention has advantages in enhancing the yarn winding efficiency of a winding apparatus.

We claim:

1. A rotating spindle drive type winding apparatus wherein a spindle, onto which a bobbin for winding a yarn to form a yarn package is inserted, is driven so that a predetermined winding factor is controlled in accordance with a predetermined program wherein said spindle drive type winding apparatus is provided with a control device which comprises:

(a) a peripheral speed detector for detecting the peripheral speed of said yarn package and generating a peripheral speed signal;

(b) a control, for controlling the rotational speed of said spindle, which receives a signal from a detector of the controlled winding factor and a preprogrammed winding signal, compares the winding factor signal and said preprogrammed signal and generates a control signal for controlling the rotational speed of said spindle;

(c) a circuit which receives said peripheral speed signal and said control signal and generates a radius signal;

(d) a function generator which receives said radius signal and emits a preprogrammed winding signal to the control based on the radius signal.

2. A spindle drive type winding apparatus according to claim 1 wherein said controlled winding factor is the peripheral speed of said yarn package wherein said peripheral speed signal is received by the control as the signal from the detector of the controlled winding factor.

3. A spindle drive type winding apparatus of claim 1, wherein said controlled winding factor is tension in running yarn, wherein said apparatus further comprises as the detector of the controlled winding factor a tension detector which detects the tension in the running yarn and provides a signal to control the tension in the yarn.

4. A spindle drive type winding apparatus of claim 1,2 or 3 wherein said spindle is driven by a synchronous motor, and a traverse device of said winding apparatus is also driven by a second synchronous motor wherein both said synchronous motors are connected to a common variable frequency power source controlled by said control signal whereby said winding apparatus is driven at a constant wind ratio.

5. A spindle drive type winding apparatus of claim 1, 2 or 3 wherein the spindle is driven by a synchronous motor and a traverse device of said winding apparatus is driven by a second synchronous motor wherein said synchronous motor which drives said spindle is connected to a variable frequency power source controlled by said control signal.

* * * * *